US005890415A

United States Patent [19]

Asou

[11] Patent Number: 5,890,415

[45] Date of Patent: Apr. 6, 1999

[54] LIQUID PUMP

[75] Inventor: Yoshiaki Asou, Kyoto, Japan

[73] Assignee: Shimadzu Corporation, Kyoto, Japan

[21] Appl. No.: 882,911

[22] Filed: Jun. 26, 1997

[30] Foreign Application Priority Data

Sep. 30, 1996 [JP] Japan ..... 8-258406

[51] Int. Cl.[6] ..... F01B 29/00

[52] U.S. Cl. ..... 92/128; 92/129; 92/130 R; 92/168; 92/255; 417/470

[58] Field of Search ..... 92/128, 129, 130 R, 92/165 R, 168, 255; 417/470

[56] References Cited

U.S. PATENT DOCUMENTS

| | | | |
|---|---|---|---|
| 1,977,075 | 10/1934 | Magnuson | 92/258 |
| 2,204,626 | 6/1940 | Scott | 92/130 R |
| 3,747,478 | 7/1973 | Dunn et al. | 92/165 R |
| 3,940,151 | 2/1976 | Phillips | 92/165 R |
| 5,078,580 | 1/1992 | Miller et al. | 92/128 |

*Primary Examiner*—F. Daniel Lopez
*Attorney, Agent, or Firm*—Majestic, Parsons, Siebert & Hsue P.C.

[57] ABSTRACT

A liquid pump has a pump head, a head holder which can be assembled with the pump head and a housing connected to the head holder, providing an internal space which connects to a liquid flow route through the pump head. A plunger assembly is disposed inside this internal space, having a plunger rod which penetrates the head holder and reaches the flow route, and a male screw part. A cross head for driving the plunger assembly is also inside this internal space, and a return spring is supported between the head holder and this cross head so as to provide a biasing force thereto. The cross head has a female screw part which is engageable with the male screw part of the plunger assembly. The plunger assembly has a hexagonal flange to which a dedicated simple jig can be engaged to rotate the plunger assembly and to thereby engage or disengage them.

9 Claims, 3 Drawing Sheets

LIQUID PUMP

BACKGROUND OF THE INVENTION

This invention relates to a liquid pump for moving the mobile phase in high-performance liquid chromatography (HPLC).

In HPLC, a pump serves to cause the mobile phase solution to be transported to the column after its deaeration by continuously applying pressure to it with a plunger. FIG. 3 shows an example of prior art pump of this kind, comprising a pump head 21, a seal holder 22, a head holder 25, a plunger assembly 27, a return spring 28 and a housing 26. The pump head 21 has an internal flow route 21*a* therethrough with unidirectional valves at its inlet and outlet sides. The plunger assembly 27 includes a plunger rod 27*a* which undergoes a reciprocating motion inside the pump head 21, the seal holder 22 and the head holder 25, as well as a spring seat 27*b*. The return spring 28 is supported by this spring seat 27*b* and is biased from behind by a cross head 29.

Pumps, used in HPLC, must be disassembled periodically for inspections because the plunger assembly must be exchanged or subjected to a maintenance work. When they are disassembled, they are usually disassembled completely into their components, as shown in FIG. 4. The pump head 21 is removed first, the seal holder 22 is removed next, followed by the head holder 25, and the return spring 28 and the plunger assembly 27 are finally removed. This sequence is reversed when the plunger assembly 27 is incorporated into the pump.

Although the structure of a pump for HPLC was described above in a simple form, real pumps are actually structured as shown in FIG. 5, having plunger assemblies 27 and return springs 28 in pairs, placed parallel to each other and undergoing their reciprocating motions alternately. When such a pump is disassembled, therefore, two return springs 28 must be removed, but this must be done by removing the screws of the head holder 25 while the return springs 28 are very cautiously stretched. Similarly, when the pump is assembled, the head holder 25 must be affixed inside the housing 26 by means of screws while the return springs 28 are compressed carefully. Such care must be taken when assembling and disassembling the pump because the return springs 28 may otherwise spring out to cause damage to the plunger assembly 27. In any event, it has been a precarious job to assemble and disassemble such a pump because of the existence of the return springs 28.

SUMMARY OF THE INVENTION

It is therefore an object of this invention to provide an improved liquid pump which does not require its return springs to be removed when it is assembled or disassembled and of which the plunger assembly can be exchanged easily.

A liquid pump embodying this invention, with which the above and other objects can be accomplished, may be characterized as comprising a pump head, a head holder which can be assembled with the pump head and a housing connected to the head holder, providing an internal space which connects to a liquid flow route through the pump head. A plunger assembly is disposed inside this internal space, having a plunger rod which penetrates the head holder and reaches the flow route, and a male screw part. A cross head for driving the plunger assembly is also inside this internal space, and a return spring is supported between the head holder and this cross head so as to provide a biasing force thereto. The cross head has a female screw part which is engageable with the male screw part of the plunger assembly. The plunger assembly has a hexagonal flange to which a dedicated simple jig can be engaged to rotate the plunger assembly and to thereby engage or disengage it with or from the cross head.

BRIEF DESCRIPTION OF THE DRAWINGS

The accompanying drawings, which are incorporated in and form a part of this specification, illustrate an embodiment of the invention and, together with the description, serve to explain the principles of the invention. In the drawings.

DETAILED DESCRIPTION OF THE INVENTION

Figure 1:
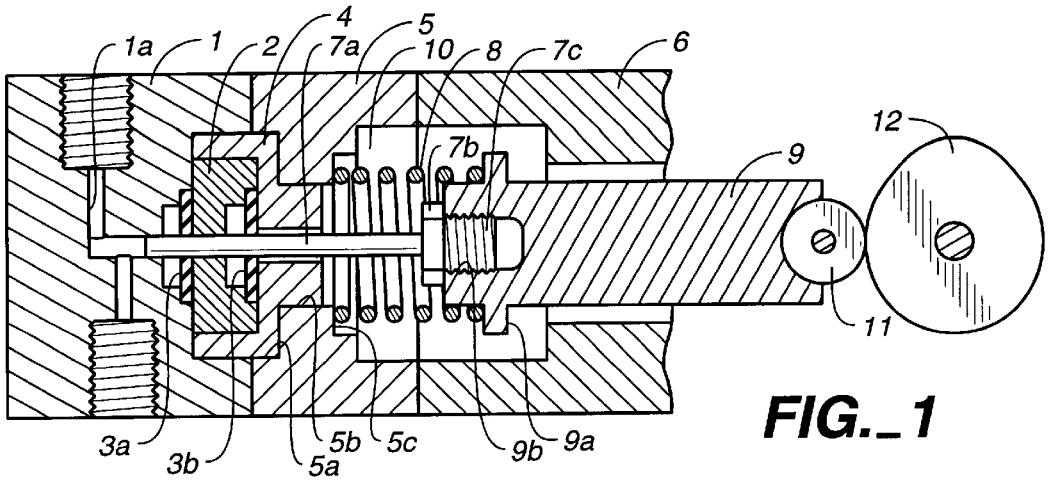
FIG. 1 is a sectional side view of a liquid pump embodying this invention when it is assembled.

Next, the invention will be described by way of an example with reference to drawings. FIG. 1 shows a liquid pump embodying this invention when it is assembled, comprising a pump head 1 having a flow route 1*a* therethrough and unidirectional valves (not shown) on its inlet and outlet sides, a seal holder 2, a ring holder 4 enveloping and supporting the entirety of this seal holder 2, a head holder 5 which supports this ring holder 4 and is affixed to the pump head 1 by means of screws (not shown), a housing 6 which fastens the head holder 5 by means of screws (not shown), a plunger assembly 7 which undergoes a reciprocating motion through the head holder 5, the seal holder 2 and the ring holder 4, a return spring 8 disposed inside an internal space 10 formed between the head holder 5 and the housing 6, and a cross head 9 which applies a biasing force on the return spring 8 in the direction of the head holder 5. The cross head 9 is provided with a flange 9*a* which supports the return spring 8.

Holes 5*a* and 5*b* are formed with a step in between inside the head holder 5 for having the ring holder 4 inserted therein, a step 5*c* being formed on the side opposite to the hole 5*a* for supporting the return spring 8. The head holder 5 is held by the housing 6 by means of screws (not shown). The return spring 8 is disposed inside the internal space 10 which is formed when the head holder 5 and the housing 6 are assembled so as to be biased and supported between the step 5*c* on the head holder 5 and the flange 9*a* of the cross head 9 which undergoes a reciprocating motion inside the housing 6.

The plunger assembly 7 is composed of a plunger rod 7*a*, a hexagonal flange 7*b* and a male screw part 7*c*. The cross head 9 has a female screw part 9*b* formed at one end, engaging with the male screw part 7*c* of the plunger assembly 7. Seals 3*a* and 3*b* are provided respectively to the pump head 1 and the seal holder 2 to seal around the plunger rod 7*a*.

A roller 11 is rotatably affixed to the other end of the cross head 9, contacting a cam 12 which can be rotated by a driving means (not shown) so as to cause the cross head 9, and hence also the plunger assembly 7, to undergo a reciprocating motion such that a mobile phase can be transported.

Figure 2A:
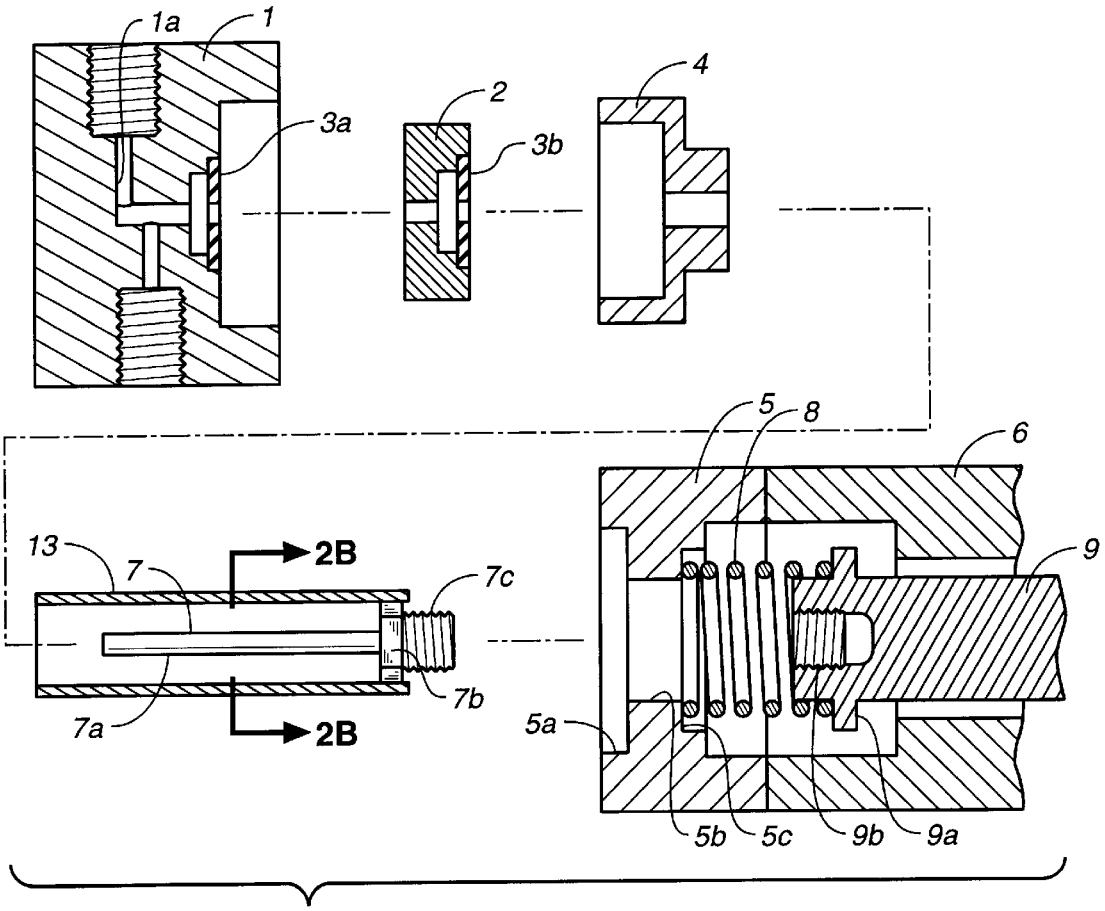
FIG. 2A is a sectional side view of the liquid pump of FIG. 1 when it is disassembled.
Figure 2B:
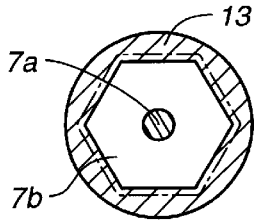
FIG. 2B is a sectional view taken along line 2B—2B of FIG. 2A.

When it is desired to exchange the plunger assembly 7 of the pump shown in FIG. 1, the screws (not shown) which are holding the pump head 1 and the head holder 5 together are removed to disassemble the seal holder 2 and the ring holder 3, as shown in FIG. 2. Next, a specially designed dedicated jig 13 is inserted around the flange 7*b* of the plunger assembly 7 and is rotated so as to disengage the male screw part 7*c* of the plunger assembly 7 from the female screw part 9*b* of the cross head 9. It is to be noted that this can be done without disassembling the head holder 5 from the housing 6 or the return spring 8 from the cross head 9.

In summary, the plunger assembly 7 of this pump, structured as described above, can be easily exchanged by using the dedicated jig 13 without disengaging the return spring 8. When another plunger assembly is inserted, too, the male screw part 7*c* of the replacing plunger assembly can be easily engaged with the female screw part 9*b* of the cross head 9 by using the same dedicated jib 13 to rotate the flange 7*b* of the inserted plunger assembly 7. After the plunger assembly 7 is thus attached to the cross head 9, the seal holder 2 is inserted to the ring holder 3, the ring holder 3 is inserted to the pump head 1, the plunger rod 7*a* of the plunger assembly 7 is passed therethrough, and the pump head 1 is fastened to the head holder 5 by means of screws to complete the assembly of the pump.

Figure 3:
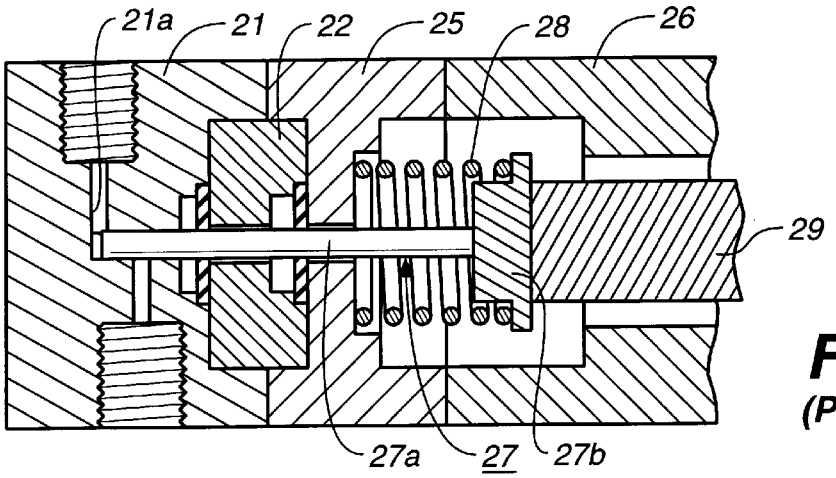
FIG. 3 (PRIOR ART)
FIG. 3 is a sectional side view of a prior art liquid pump when it is assembled.
Figure 4:
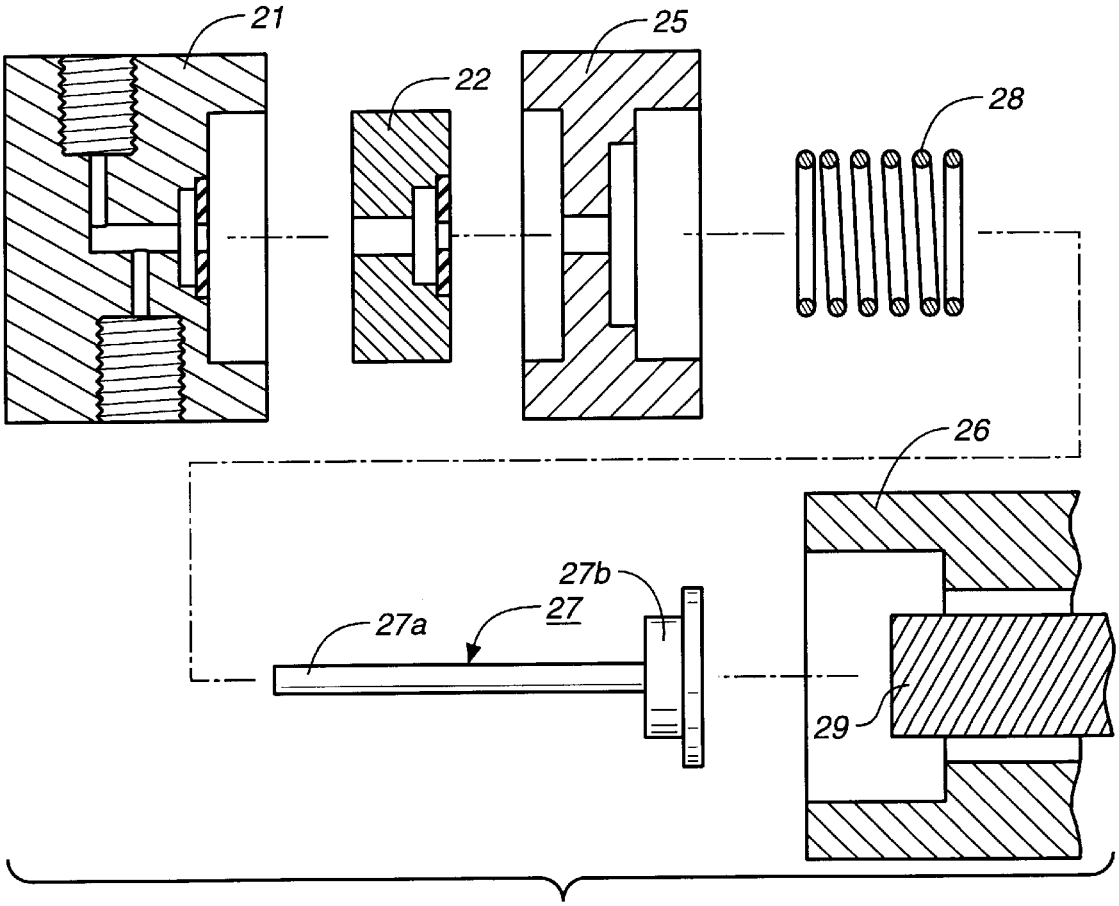
FIG. 4 (PRIOR ART)
FIG. 4 is a sectional side view of the prior art liquid pump of FIG. 3 when it is disassembled.
Figure 5:
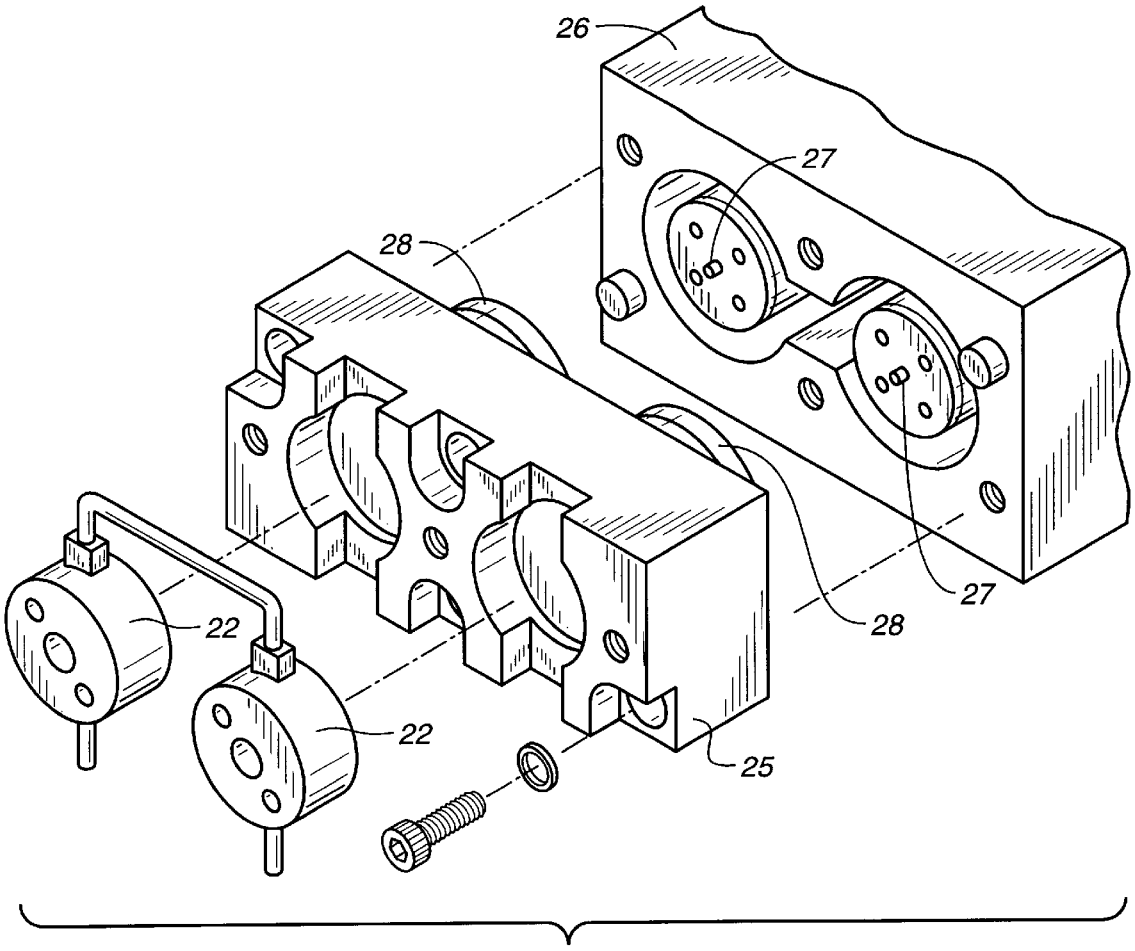
FIG. 5 (PRIOR ART)
FIG. 5 is a diagonal view of a portion of the prior art liquid pump when it is disassembled.
Figure 6:
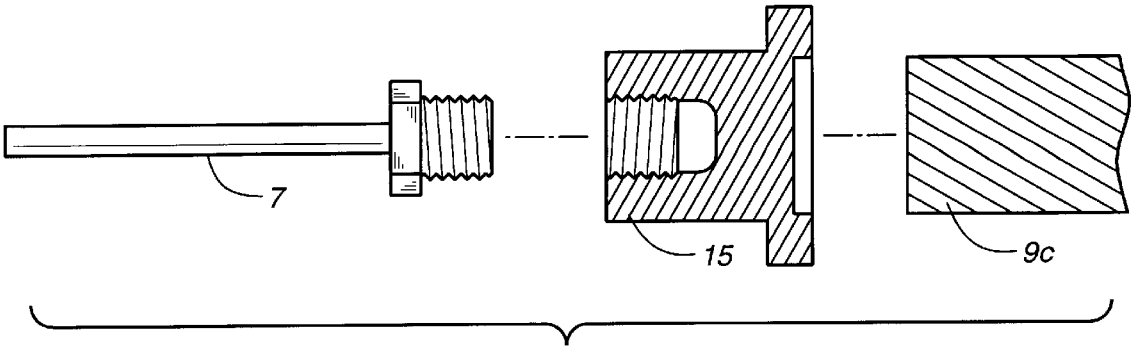
FIG. 6 is a sectional side view of a cross head and a plunger assembly of another liquid pump embodying this invention.

Although the invention has been described above with reference to only one example, this example is not intended to limit the scope of the invention. Many modifications and variations are possible within the scope of this invention. Although a plunger assembly with a male screw part and a cross head with a matching female screw part were described above, a female screw part may be provided instead to the plunger assembly and a matching male screw part to the cross head. As a further alternative, as shown in FIG. 6, the cross head 9 may be structured so as to be separable into a spring seat 15 and an elongated rod-like part 9*c* (as shown in FIG. 3), the spring seat 15 being adapted to receive and be connected to the plunger assembly 7 so as to support one end of the return spring 8. Although a hexagonal flange was disclosed on the plunger assembly, the flange on the plunger assembly need not be hexagonal. The flange may be of any shape, other than a circle, so long as it can be engaged with a jig and rotated by its rotation.

In summary, liquid pumps according to this invention are easier to assemble and disassemble by means of a single jig without having the return springs removed. Thus, the plunger assembly can be exchanged without the fear of causing any damage thereto, and the maintenance work is simplified.

What is claimed is:

1. A liquid pump comprising:

a pump head having a flow route therethrough;

a head holder which has a step formed thereon and is removably assembled with said pump head;

a housing connected to said head holder to thereby provide an internal space;

a plunger assembly having a plunger rod and a first screw part, said plunger rod penetrating said head holder and reaching said flow route;

a return spring disposed in said internal space, and adapted to apply a biasing force on said plunger assembly; and a cross head disposed inside said internal space for driving said plunger assembly, said return spring being supported between said step formed on said head holder and said cross head so as to provide a biasing force thereto, said cross head having a second screw part which is disengageably engageable with said first screw part, whereby said pump head is selectively removable from said liquid pump without also removing said return spring.

2. The liquid pump of claim 1 wherein said plunger assembly also has a flange, said liquid pump further comprising a jig for engaging with said flange and causing said flange to rotate and to thereby cause said plunger assembly to engage with or disengage from said cross head.

3. The liquid pump of claim 2 further comprising a ring holder and a seal holder, said ring holder being sandwiched between said pump head and said head holder, said seal holder being enveloped and supported by said ring holder between said ring holder and said pump head, said plunger rod also penetrating said ring holder and said seal holder.

4. The liquid pump of claim 2 wherein said first screw part and said second screw part are rotatable around an axis in the direction of said plunger rod and said jig engages with said flange from the direction of said pump head.

5. The liquid pump of claim 1 further comprising a ring holder and a seal holder, said ring holder being sandwiched between said pump head and said head holder, said seal holder being enveloped and supported by said ring holder between said ring holder and said pump head, said plunger rod also penetrating said ring holder and said seal holder.

6. The liquid pump of claim 1 wherein said cross head is separable into an elongated member and a spring seat, said spring seat having said second screw part, said return spring being supported between said spring seat and said head holder.

7. The liquid pump of claim 1 wherein said first screw part and said second screw part are rotatable around an axis in the direction of said plunger rod.

8. A liquid pump comprising:

a pump head having a flow route therethrough;

a head holder which is assembled with said pump head;

a housing connected to said head holder to thereby provide an internal space;

a plunger assembly having a plunger rod and a first screw part, said plunger rod penetrating said head holder and reaching said flow route;

a return spring disposed in said internal space, and adapted to apply a biasing force on said plunger assembly;

a cross head disposed inside said internal space for driving said plunger assembly, said return spring being supported between said head holder and said cross head so as to provide a biasing force thereto, said cross head having a second screw part which is disengageably engageable with said first screw part;

a ring holder; and a seal holder, said ring holder being sandwiched between said pump head and said head holder, said seal holder being enveloped and supported by said ring holder between said ring holder and said pump head, said plunger rod also penetrating said ring holder and said seal holder, said head holder having a hole with a step, said ring holder being inserted into said hole.

9. A liquid pump comprising:

a pump head having a flow route therethrough;

a head holder which is assembled with said pump head;

a housing connected to said head holder to thereby provide an internal space;

a plunger assembly having a plunger rod, a flange and a first screw part, said plunger rod penetrating said head holder and reaching said flow route;

a return spring disposed in said internal space, and adapted to apply a biasing force on said plunger assembly;

a cross head disposed inside said internal space for driving said plunger assembly, said return spring being supported between said head holder and said cross head so as to provide a biasing force thereto, said cross head having a second screw part which is disengageably engageable with said first screw part;

a jig for engaging with said flange and causing said flange to rotate and to thereby cause said plunger assembly to engage with or disengage from said cross head;

a ring holder which is sandwiched between said pump head and said head holder; and a seal holder which is enveloped and supported by said ring holder between said ring holder and said pump head, said plunger rod also penetrating said ring holder and said seal holder, said head holder having a hole with a step, said ring holder being inserted into said hole.

* * * * *